US009651210B2

(12) United States Patent
Ziegler et al.

(10) Patent No.: US 9,651,210 B2
(45) Date of Patent: May 16, 2017

(54) LIGHT SOURCE MODULE FOR MOTOR VEHICLE HEADLAMPS

(71) Applicant: Automotive Lighting Reutlingen GmbH, Reutlingen (DE)

(72) Inventors: Patrick Ziegler, Reutlingen (DE); Armin Austerschulte, Stuttgart (DE); Christian Buchberger, Reutlingen (DE); Henning Hogrefe, Walddorfhäslach (DE); Martin Reichelt, Mössingen (DE); Ulrike Schloeder, Reutlingen (DE); Henning Vogt, Stuttgart (DE)

(73) Assignee: Automotive Lighting Reutlingen GmbH, Reutlingen (DE)

( * ) Notice: Subject to any disclaimer, the term of this patent is extended or adjusted under 35 U.S.C. 154(b) by 70 days.

(21) Appl. No.: 14/761,992

(22) PCT Filed: Dec. 20, 2013

(86) PCT No.: PCT/EP2013/077603
§ 371 (c)(1),
(2) Date: Jul. 20, 2015

(87) PCT Pub. No.: WO2014/114417
PCT Pub. Date: Jul. 31, 2014

(65) Prior Publication Data

US 2015/0316223 A1 Nov. 5, 2015

(30) Foreign Application Priority Data

Jan. 22, 2013 (DE) ..... 10 2013 200 925

(51) Int. Cl.
*F21S 8/10* (2006.01)

(52) U.S. Cl.
CPC ..... *F21S 48/1145* (2013.01); *F21S 48/1154* (2013.01); *F21S 48/1195* (2013.01);
(Continued)

(58) Field of Classification Search
CPC .. F21S 48/1145; F21S 48/1154; F21S 48/195; F21S 48/1225; F21S 48/1747; F21S 48/328; F21S 48/1778
See application file for complete search history.

(56) References Cited

U.S. PATENT DOCUMENTS

2012/0106178 A1 5/2012 Takahashi et al.
2013/0265793 A1 10/2013 Helbig et al.
(Continued)

FOREIGN PATENT DOCUMENTS

EP 2 525 140 A2 11/2012
EP 2 551 154 A2 1/2013
(Continued)

OTHER PUBLICATIONS

International Search Report and Written Opinion of the International Searching Authority for PCT International App. No. PCT/EP2013/077603 mailed Jun. 27, 2014.

*Primary Examiner* — Anabel Ton
(74) *Attorney, Agent, or Firm* — Howard & Howard Attorneys PLLC

(57) ABSTRACT

The invention relates to a light-source assembly, comprising at least one laser light source, a photoluminescence element, which is designed in such a way that, as the result of incident laser light, a mixed light distribution can be emitted by using photoluminescence and which is arranged in such a way that the laser light of the at least one laser light source can be radiated onto the photoluminescence element, and at least one light-emitting diode for emitting a supplemental light distribution, wherein the at least one laser light source, the
(Continued)

photoluminescence element, and the at least one light-emitting diode are fastened to a common carrier component as an assembly. The invention further relates to a motor vehicle headlamp having such a light-source assembly.

8 Claims, 2 Drawing Sheets

(52) U.S. Cl.
CPC ..... *F21S 48/1225* (2013.01); *F21S 48/1747* (2013.01); *F21S 48/328* (2013.01); *F21S 48/1778* (2013.01)

(56) References Cited

U.S. PATENT DOCUMENTS

| | | | | |
|---|---|---|---|---|
| 2014/0340918 | A1* | 11/2014 | Suckling ..... | F21V 9/16 362/510 |
| 2015/0138799 | A1 | 5/2015 | Schwaiger et al. | |

FOREIGN PATENT DOCUMENTS

| | | | |
|---|---|---|---|
| JP | 2010092747 | A | 4/2010 |
| JP | 2010232044 | A | 10/2010 |
| WO | 2012/084481 | A1 | 6/2012 |
| WO | 2013/156518 | A1 | 10/2013 |

* cited by examiner

LIGHT SOURCE MODULE FOR MOTOR VEHICLE HEADLAMPS

CROSS-REFERENCE TO RELATED APPLICATIONS

The present application is a National Stage of International Patent Application No. PCT/EP2013/077603, filed on Dec. 20, 2013, which claims priority to and all the benefits of German Patent Application No. 10 2013 200 925.9, filed on Jan. 22, 2013, both of which are hereby expressly incorporated herein by reference in their entirety.

BACKGROUND OF THE INVENTION

1. Field of the Invention

The invention concerns a light source module for motor vehicle headlamps as well as headlamps for such a light source module.

2. Description of the Related Art

Light-emitting diodes (LEDs) are being increasingly used as illuminants for vehicle headlamps. The advantages of the LED in comparison to conventional illuminants lies with the higher efficiency and a comparatively long service life. LEDs can also be constructed as compact modules. However, LEDs can often only achieve fairly low lighting intensities as compared to, for example, halogen lamps.

Laser light sources, particularly semiconductor lasers, offer a number of potentially advantageous properties, such as for example a comparatively small light-emitting area, high radiation intensities and luminance as well as the emission of largely collimated and polarized light beams. Optical systems for laser light can therefore be implemented in small spaces, for example as smaller focal lengths can be chosen than for optical systems for less strongly collimated light beams of for example light bulbs or conventional LEDs. The use of laser light sources can therefore allow for a compact construction of motor vehicle headlamps.

Generally speaking, one can distinguish between two types of light distributions for motor vehicle headlamps: the dimmed (low beam) distribution as well as the high beam distribution.

The low beam distribution is primarily intended to illuminate the area in front of the vehicle. This is supposed to prevent other road users, particularly opposing traffic, from being adversely affected (blinded). A low beam distribution (such as low beam headlamps, fog lights) therefore often have a light-dark threshold divided into horizontal sections. This division can also exhibit an adjusted contour, for example the light-dark threshold facing the opposing traffic can be vertically lower than the section facing away from the opposing traffic. Particularly, a diagonally ascending section of the light-dark threshold can be provided between these two horizontal sections (a so-called "Z-shape").

The high beam distribution can be composed of a comparatively narrow lighting area (spot light distribution) above the light-dark threshold of the low beam distribution and a basic light distribution for the even illumination beneath or in the area of the light-dark threshold of the low beam light distribution.

In order to prevent adverse effects on other road users, the low beam light distribution is generally of lower intensity than the high beam one. High intensities are generally desired for the high beam distribution in order to illuminate areas that are further away. This is why the use of laser light sources is particularly beneficial for a high beam application.

Problems regarding the use of laser light sources for motor vehicle headlamps however arise, on one hand, from the fact that lasers generally emit a coherent, monochromatic light or light of a narrow wave length area. White mixed light is, however, usually desired or legally prescribed for the light emitted from motor vehicle headlamps. Furthermore, the emission distributions are supposed to exhibit certain, partially legally prescribed intensity curves (for example as described above). Measures for the conversion into suitable light must therefore be taken.

To convert monochromatic light into, for example, white mixed light, the use of photo luminescence converts or photo luminescence elements is generally known in the area of white LEDs or luminescence conversion LEDs. These consist, for example, of a photo luminescence coloring agent in a, for example, semi-transparent substrate and are arranged immediately on the light-emitting section of the LED. The light of a colored (for example blue) LED excites the photo luminescence coloring agent to start the photo luminescence process, which causes the photo luminescence coloring agent itself to emit light of a different wavelength (for example yellow). In this manner, at least a part of the emitted light of a wavelength range can be converted into light of a different wavelength range. Usually, another part of the emitted light is scattered by the photo luminescence element. The scattered light and the light emitted by the photo luminescence can then additively superimpose and achieve the desired, for example white, mixed light.

When using laser light sources, a precise adjustment of the laser light source to the photo luminescence element and possibly required optical devices for guiding, shaping or deflection of the laser light is needed due to the typically heavily collimated light beams with small beam diameters.

Known motor vehicle headlamps with laser light sources are therefore often fixedly installed inside the housing of the headlamp to prevent a misalignment of the laser light source in reference to the optical devices and/or the photo luminescence element. US 2012/0106178 A1, for example, describes an illumination device with a laser light source that is permanently arranged inside a housing reflector unit. Such arrangements complicate headlamp repairs if the laser light source fails. Manufacturing of a functional headlamp unit can also be complicated as well as complex as the laser light source has to be aligned inside the entire headlamp unit.

SUMMARY OF THE INVENTION

The intention of the invention at hand is to make proper use of the advantages presented by LEDs as well as the advantages of laser light sources for motor vehicle headlamps and to also allow for a comfortable repair and maintenance of the motor vehicle headlamps.

The light source module is comprised of at least one laser light source, preferably a laser diode, used to emit laser light as well as photo luminescence element, which is designed in such a manner that contact of the laser light allows for a mixed light distribution to be emittable using the photo luminescence effect. The photo luminescence element is arranged in such a manner that the laser light of at least one laser light source can come into contact with the photo luminescence element. The emission of the mixed light distribution is particularly provided by a partial conversion of the laser light by photo luminescence and partially by diffuse and/or incoherent scattering of the laser light on the photo luminescence element. The converted light has a different wave length than the emitted laser light and can additively mix to, for example, white light in conjunction with the light scattered on the photo luminescence element. In this respect, the photo luminescence element acts as the actual light source of the mixed light distribution.

Furthermore, the light source module comprises at least one additional light source, which is provided by a light-emitting diode. This diode serves the purpose of emitting a supplementary light distribution. With this light source module, at least one of these laser light sources, the photo luminescence element and at least one light-emitting diode are mounted on a joint carrier component as a single module.

Such a light source module can be designed as a compact unit. All light-emitting parts as well as other optical and electric components are integrated as modules on the carrier component. With a headlamp that uses light-emitting diodes and laser light sources as illuminants, the light source module simplifies maintenance in the event of a defect. As an example, the entire light source module can be replaced as a whole similar to a conventional lamp.

The light distributions emitted by the laser light source and light-emitting diode can be combined in an advantageous manner. As an example, the mixed light distribution provided by the laser light source, which usually has a high radiation intensity, can feed the high beam distribution of a headlamp unit. The supplementary light distribution can feed the low beam distribution of the headlamp. A light-emitting diode with a comparatively low radiation intensity can be used. This avoids adverse effects on opposing traffic with the low beam distribution. A headlamp unit fitted with the light source module in question can profit from the high intensities and strong beam focus as well as the efficiency and reliability of the light-emitting diode and their comparatively inexpensive manufacturing costs.

Electrical contacts are provided on the carrier component, preferably independent of one another, for at least one light-emitting diode and at least one laser light source so that the light source module for emitting the mixed light distribution and the supplemental light distribution can be controlled independent of one another.

The carrier component may be designed as a single piece and can particularly be provided with different from sections (such as the front section, base section, intermediate section, socket section, etc.) as described in the following.

A laser light source lens can be provided in the beam path between the laser light source and the photo luminescence element, for example a light guide, lens arrangement or radiation filter element.

The carrier component is preferably provided with a front section for the longitudinally arranged light source unit and a base section located in the rear. Here, at least one light-emitting diode is arranged on the front section, whereas at least one laser light source is provided on the base section. Such a spatial division of the two light source types can, for example, be used to achieve enough space for the use of multiple laser light sources and light-emitting diodes. The spatial separation can also be advantageous in order to ensure an efficient heat dissipation of the individual light sources and to avoid an undesired mutual heating of the light sources.

The front section is spaced apart from the base section. To this end, the carrier component can be provided with an intermediate section, which would then be located between the front section and the base section.

The photo luminescence element can also be arranged on the front section. With such an arrangement, all components that emit the actually used light are located on the front section. The base section is primarily used as a mount, power supply and, if required, for cooling the light source module, particularly the laser light source in this case.

An efficient heat dissipation can, however, also be achieved by the carrier component being provided with at least two spaced apart air gaps, whereas the photo luminescence element is positioned at one sectional gap and the light-emitting is positioned at the other one (geometrical thermal separation of photo luminescence element and light-emitting diode). The carrier component can also have a thermally isolated separating section, which is located between the first and section sections with the photo luminescence element being placed at one section and the light-emitting diode placed at the other (material-based thermal separation of photo luminescence element and light-emitting diode).

Another advantageous development results from the circumstance that a laser guidance lens (for example a light guide) is used to guide the laser light of at least one laser light source to the photo luminescence element located on the front section.

The light-emitting diode is preferably provided with its own optical head, which largely leaves the mixed light distribution emitted from the photo luminescence element unaffected. Such an independent optical head for the light-emitting diode can be advantageous in order to collimate the light of the laser-emitting diode independent of the laser light and to form, for example, a light distribution suitable for a low beam application.

It would also be conceivable to provide a deflection reflector and/or collection reflector for the light-emitting diode, using which only the supplemental light distribution is deflected or focused and which leaves the mixed light distribution largely unaffected.

Another advantageous development of the carrier component results from this component being provided with a laser transmission channel, which is located between two opposing surfaces of the carrier component and through which light can be emitted. The transmission channel leads to a suitable beam opening on both sides of the surfaces.

A laser transmission channel extending through the carrier component acts to provide at least a first and second laser light source, whereas the first and second laser light sources are arranged on the carrier component in such a manner that at least a section of the carrier component is located between the first and second laser light source and/or at least partially between the laser light beams emitted from both laser light sources. In this manner, it is possible to arrange multiple laser light sources on the carrier component. Through the sections of the carrier component between the laser light sources and/or the laser light beams, it is then, for example, possible to provide efficient cooling for the individual laser light sources.

The transmission channel may be arranged inside the intermediate section, which is located between the aforementioned front section and the likewise aforementioned base section of the carrier component. As a further development, the carrier component may include a beam deflector to guide the light of at least one laser light source through the transmission channel.

For example, it is possible to arrange a deflection reflector on one side of the carrier component on which the first laser light source is positioned, which is designed in such a manner that the light of this first laser light source is guided through the transmission channel using the deflection roller. On the other side of the transmission channel, for example in the area of the transmission opening leading to this surface, a beam combination measure or beam unification measure can then be provided, using which laser light of the first laser light source (which passes through the transmission channel) and laser light of a second laser light source (which is, for example, arranged on the first side opposing the second side) can be combined.

To ensure an efficient cooling of the carrier component, it may be manufactured using a thermally conductive material in such a manner that the waste heat of at least one laser light source and/or at least one light-emitting diode and/or the photo luminescence element can be deflected. A material whose thermal conductivity exceeds 20 W/(K*m), particularly above 100 W/(K*m) may be selected for this purpose. The carrier component may be made of metal, for example copper, aluminum, iron or an alloy of different metals. The use of thermally conductive ceramics or plastic would, however, also be conceivable.

The carrier component can be provided with a heat sink section, which is positioned in such a manner that at least one laser light source and/or at least one light-emitting diode and/or the photo luminescence element can be cooled, meaning that the waste heat can be primarily discharged using the heat sink section. The heat sink section can, for example, be connected with the carrier component in one piece. It would, however, also be feasible to provide the heat sink section from a separate heat sink, which is connected with a contact section of the carrier component using a thermally conductive contact.

As another development, the light source module can be provided with a carrier base, which comprises alignment measures used to align or adjust the light source unit when arranged inside a headlamp and/or mounting fixture for fastening the light source module inside a headlamp unit. The carrier base can be connected to the carrier component as a single piece and be particularly designed as a socket section of this carrier component. The socket section is arranged on the aforementioned base section of the carrier component or covers this base section. It would, however, also be feasible that the carrier base be designed as a separate component on which the carrier component (not a single piece) is mounted. The carrier base is fitted to other components (such as the housing) of a headlamp unit in a releasable manner, for example using bayonet mountings.

The alignment measures on the carrier base allow for the light source module as a complex unit to be aligned in reference to optical facilities (such as the primary or secondary optics) of a headlamp unit. This ensures a secure assembly in spite of unfavorable assembly conditions (such as darkness). This allows for a comfortable maintenance and repair of the headlamp unit. The alignment measures can, for example, be provided as edges for the engagement into correspondingly shaped recesses on a component of the headlamp unit (for example its housing). A development of the alignment measures as guide holes is also feasible.

The carrier base allows for the light source module to simply be replaced as a whole in the event of required maintenance. Due to the alignment measures, no complex adjustment is necessary as the laser light source and photo luminescence element as well as the light-emitting diode within the light source module are already arranged in an adjusted manner. The alignment measures can also secure the adjustment of the mixed light and supplemental light distributions created by the light source unit in reference to other optical facilities of the headlamp unit.

The carrier base may include contact devices (for example contact areas or plug connections) for the electrical power supply of the laser light source and light-emitting diode.

Another development results from the carrier base being in thermally conductive contact with a heat sink so that heat emitted by the light sources as well as the photo luminescence element arranged on the carrier component can be discharged through the carrier base. The carrier base can be provided with a heat contact section through which the carrier base is connected to a heat sink or cooling section of the headlamp unit upon installation into such a unit and through which the created heat can be discharged.

The light source unit may be equipped with a laser transmission housing, which surrounds at least a part of the carrier component, whereas the transmission housing has at least one transparent beam transmission area through which the light of the mixed light and supplemental light distribution can exit. The transmission housing is, for example, designed as a transparent tube or bell, made of glass or a transparent, heat-resistant plastic. This transmission housing preferably covers all light-emitting components of the light source module. The transmission housing can be used to form a closed module, which is limited by the transmission housing and the carrier component or, if applicable, the carrier base. Due to this design, all optical and electrical components of the light source unit can be protected from damage while the unit is being accessed (for example when repairing the headlamp unit).

The transmission housing is also provided with a connective opening, using which it can be attached to the carrier component and using which the transmission housing can be mounted on the carrier component or carrier base.

The problem associated with the related art is solved by a motor vehicle headlamp of the present invention, which is equipped with an optical emission unit for converting an initial light distribution of a light source unit into an emittable light distribution of a headlamp. In accordance with this invention, a light source module as described in the aforementioned sections is used to create such an initial light distribution.

Such a motor vehicle headlamp is particularly maintenance-friendly as the light source unit can be replaced in a simple manner. A complex adjustment of the laser light source in reference to the photo luminescence element and/or the laser light source in reference to the light-emitting diode is not required.

The initial light distribution of the light source module comprises both the mixed light distribution emitted from the laser light sources as well as the supplemental light distribution emitted by the light-emitting diodes.

The optical emission unit of the headlamp preferably comprises a primary optical unit for converting the initial light distribution of the light source module into a primarily light distribution as well as a secondary optical unit for converting the primary light distribution into an emittable light distribution of the headlamp unit.

The primary optics unit can be designed and arranged in such a manner that it only effects the mixed light distribution emitted by the photo luminescence element and leaves the supplemental light distribution unaffected. This can be advantageous, particularly if the light-emitting diode is provided with its own optical head as explained above, which only effects the light distribution emitted by the light-emitting diode. The primary optics unit can, however, be designed and arranged in such a manner that it effects both the mixed light distribution as well as the supplemental light distribution.

The primary optics unit might, for example, be designed as an optical head for the light source module. It is also feasible that the primary optics unit be designed as a reflector or comprises such a reflector among other facilities. This reflector can at least partially surround the light source module and, for example, be open in the main beam direction of the headlamp. The reflector can be provided with a receptacle section (e.g. for a socket opening) into which the light source module can at least be partially inserted in such a manner that the mixed light and supplemental light distributions can be deflected in the direction of the reflector.

The secondary optics unit may be designed as a projection lens using which the primary light distribution can be projected into the emitted light distribution. The secondary optics unit can also comprise a reflector as well.

The light source module may be arranged and the optical emission unit may be designed in such a manner that the mixed light distribution generated by the light source module during operation of the headlamp is converted into a high beam distribution for the headlamp while the supplemental light distribution generated by the light source module is converted into a low beam distribution for the headlamp. To this end, the light-emitting diode or light-emitting diodes of the light source module can be provided with an optical head, which only affects the light emitted by the LEDs and achieves a supplemental light distribution with the properties desired for a low beam light distribution.

An aperture is preferably arranged within the beam bath, but after the light source module (particularly within the beam path between the light source module and a secondary optics unit, through which the emitted light distribution exits). It may be designed in such a manner that the supplemental light distribution can be deactivated in such a manner that the emitted light distribution has a light-dark threshold, if only the light-emitting diode or light-emitting diodes and not the laser light source or the laser light sources are actuated to emit light. To this end, the aperture can particularly be provided with an aperture frame, which matches the light-dark threshold via the secondary optics unit. The aperture can be designed in such a way that it can be moved into the beam path and out of the beam path.

As the photo luminescence element constitutes the actual light source of the mixed light distribution, inhomogeneities of the photo luminescence element or slight tolerances of the laser light source adjustment with regard to the photo luminescence element can lead to undesired variations in intensity or color for the mixed light distribution. These would have a particularly adverse effect on the headlamp unit, especially the high beam distribution. To counter this, the optical emission unit and/or the light source module can be designed in such a manner that the supplemental light distribution can overlap with such critical areas of the mixed light distribution where undesired intensity variations and/or color variations can occur. The combination of light-emitting diodes and laser light source can, in this manner, improve the reliability of the headlamp unit. It is likewise possible to purposefully adjust the color or color temperature of the emitted light distribution of the headlamp by selecting the color distribution or color temperature of the light-emitting diode or light-emitting diodes through targeted superimposition of the supplemental and mixed light distribution.

BRIEF DESCRIPTION OF THE DRAWINGS

Other details and advantageous developments of the invention are specified in the following description, based on which the design variant of the invention shown in the Figures is described and explained in more detail, wherein.

DETAILED DESCRIPTION OF THE INVENTION

To improve clarity, the same reference signs are used in the following description as well as Figures for corresponding features and components of the invention.

Figure 1:
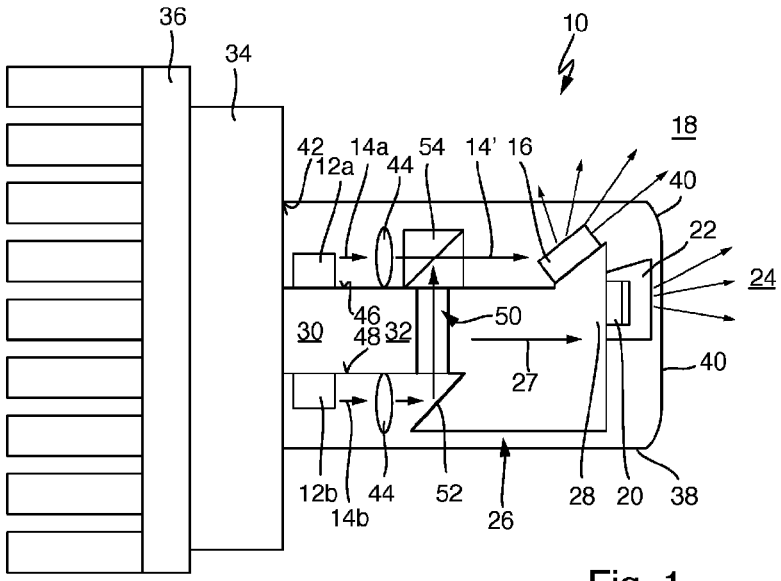
FIG. 1 is a schematic longitudinal section of a light source module in accordance with the invention.

FIG. 1 shows a light source module 10, which is comprised of a first laser light source 12*a* and a second laser light source 12*b*. The laser light sources 12*a* and 12*b* may be designed as semiconductor lasers (laser diodes). The first laser light source 12*a* emits a first laser light beam 14*a* while the second laser light source 12*b* emits a second laser light beam 14*b*.

A photo luminescence element 16 is positioned in such a manner that the laser light beams 14*a* and 14*b* emitted from laser light sources 12*a* and 12*b* (if required, after deflection through a laser guidance optics unit, as described below) hit the photo luminescence element 16 and can excite these to emit a mixed light distribution 18.

The light source module 10 also comprises a light-emitting diode 12, which is arranged in regard to an optical head 22 in such a manner that the light emitted from the light-emitting diode 20 is converted into a supplemental light distribution 24.

The light sources 12*a*, 12*b*, 20 and the photo luminescence element 16 as well as the optical head 22 (and, if required, additional components described in detail in the following) are arranged on a joint carrier component 26. The carrier component is preferably provided as a single piece body in the longitudinal direction 27 made of a particularly thermally conductive material.

The carrier component 26 has a front section 28 in the longitudinal direction 27. Opposite from this (meaning in the rear with regard to the longitudinal direction 27), the carrier component 26 is provided with a base section 30. There is an intermediate section 32 of the carrier component 26 between the base section 30 and the front section 28.

The carrier component 26 is mounted on the carrier base 34 with its base section 30. In the shown example, the carrier base 34 is provided as a separate component, which is permanently connected with the carrier component 26, for example using screws. It would, however, also be feasible that the carrier base 34 is formed by a socket section of the carrier component 26, which connects to the base section 30. In this manner, the carrier base and carrier component form a coherent, particularly a single-piece, component.

In the presented example, the connection between the carrier base 34 and carrier component 26 is to be designed in such a manner that the waste heat of the light sources 12*a*, 12*b*, 20 and/or the photo luminescence element 16 is discharged through the carrier component 26 into the carrier base 34. For cooling purposes, the carrier base 34 is preferably connected with a heat sink 36, which in the presented example is arranged on the carrier base 34 facing away from the carrier component 26 (in the direction opposing the carrier's longitudinal direction 27).

It would also be feasible that the heat sink 36 be arranged on the carrier component 26 and/or the carrier base 34 as a single piece. Carrier component 26, carrier base 34 and heat sink 36 can particularly be provided as a single body made of thermally conductive material.

The carrier component 26 is positioned within a tube-shaped transmission housing 38, which has a light-transparent transmission area 40 at least in the area of the front section 28 of the carrier component 26. The transmission housing 38 can, however, also be provided as a wholly transparent component, for example a glass tube. The transmission housing 38 has a connective opening 42 in the presented example, which is in contact with the carrier base 34. In the area of the connective opening 42, the transmission housing 38 is mounted on the carrier base 34. In this manner, the carrier component 26 as well as the optical and electrical components arranged on it are enclosed and protected by a housing made up of the transmission housing 38 and the carrier base 34.

The carrier component 26 is positioned within a tube-shaped transmission housing 38, which has a light-transparent transmission area 40 at least in the area of the front section 28 of the carrier component 26. The transmission housing 38 can, however, also be provided as a wholly transparent component, for example a glass tube. The transmission housing 38 has a connective opening 42 in the presented example, which is in contact with the carrier base 34. In the area of the connective opening 42, the transmission housing 38 is mounted on the carrier base 34. In this manner, the carrier component 26 as well as the optical and electrical components arranged on it are enclosed and protected by a housing made up of the transmission housing 38 and the carrier base 34.

FIG. 1 shows an exemplary development of the laser guidance optics. Lenses 44 can be provided downstream from the laser light sources 12*a* and 12*b* in the beam path (cf. FIG. 1). These can serve to collimate the laser light beam 14*a* and 14*b* or to shape them in accordance with requirements.

In the presented example, the carrier component 26 is limited in the vertical direction to the longitudinal direction of the carrier 26 from a first surface 46 and an opposing second surface 48. The first surface 46 defines a top side, the second surface 48 defines an underside of the carrier component 26. In the area of the intermediate section 32, the carrier component 26 has a laser transmission channel 50. This channel pushes through the carrier component 26 in the rough vertical direction in reference to the carrier's longitudinal direction and leads to the first surface 46 of the first transmission opening, on the second surface 48 on the second transmission opening so that light from the underside can be emitted through the transmission channel 50 to the top side.

The first laser light source 12*a* is arranged on the first surface 46 while the second laser light source is arranged on the second surface 48 of the carrier component 26. The base section 30 of the carrier component 26 is therefore located between the laser light sources 12*a* and 12*b*, which allows for an efficient cooling of the laser light sources 12*a* and 12*b* to be provided.

The intermediate section 32 reaches between the laser light beams 14*a* and 14*b* emitted from the laser light sources 12*a* and 12*b*. The first laser light beam 14*a* extends from the side of the carrier component 26 on which the photo luminescence element 16 is arranged as well. The second laser light beam 14*b* on the other hand is directed in the area immediately after the second laser light source 12*b* to the opposing side of the carrier component 26. In order to also guide the light emitted from the second laser light source 12*b* to the photo luminescence element 16, a deflection reflector 52 is arranged on the carrier component 26 in such a manner that a second laser light beam 14*b* can be guided through the transmission channel 50 on the top side of the carrier component 26 using the deflection reflector 52.

A beam division element 54 is arranged in the area where the transmission opening of the transmission channel 50 flows into the first surface 46, using which the emitted first laser light beam 14*a* can be joined with the laser light beam 14*b* flowing through the transmission channel 50 and forms a collective light beam 14'. The collective light beam 14' then hits the photo luminescence element 16 along the further beam path.

Such a combination using a beam division element 54 is particularly beneficial as laser light sources usually emit linearly polarized light. For example, the polarization direction of the laser light source 12*a* can be selected vertically to the polarization direction of the laser light source 12*b*. The beam division element 54 is then preferably provided as a polarization beam divider, which can combine the light of a first polarization direction (in the first laser light beam 14*a*) and the light of a second polarization direction (in the second laser light beam 14*b* coming through the transmission channel 50) to one collective light beam 14', practically without loss.

To simplify the manufacturing of the light source module 10, the carrier component 26 can be provided with adjustment mechanism, for example installation edges on which the individual components (light sources 12*a*, 12*b*, 20; photo luminescence element 16; optical head 22; beam divider 54, etc.) can be mounted for assembly and thereby kept in their positions. Likewise, markings can be provided on the surfaces of the carrier component 26, which define the positions of the components to be arranged.

Figure 2:
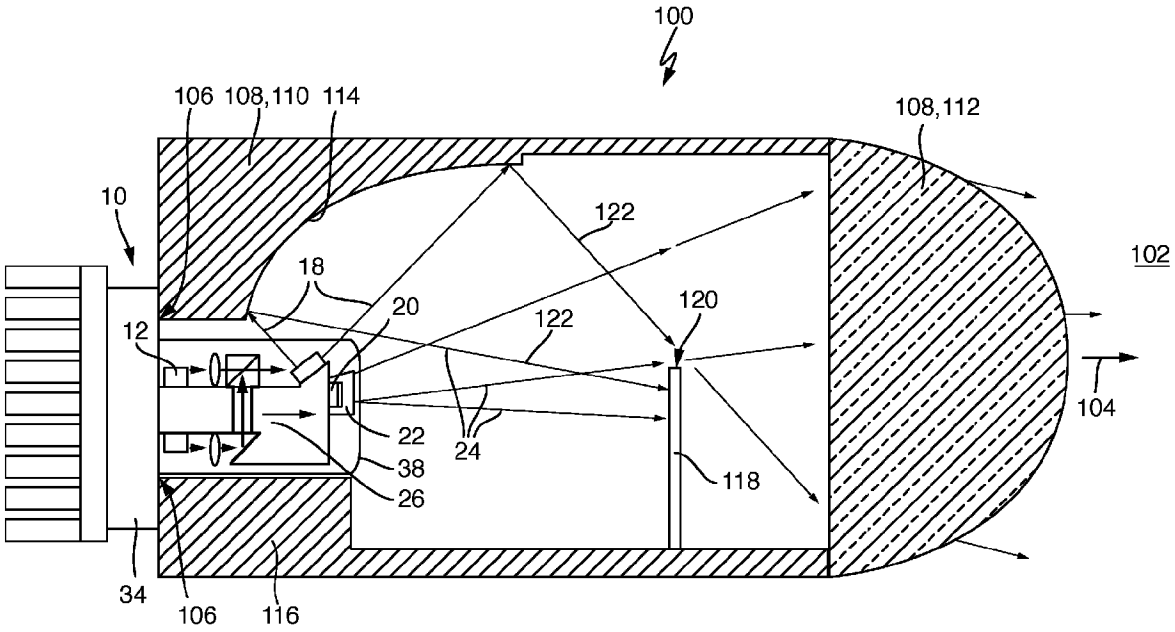
FIG. 2 is a schematic longitudinal section of a motor vehicle headlamp with a light source module in accordance with the invention.

FIG. 2 shows a motor vehicle headlamp 100 used to generate an emittable light distribution 102, which is preferentially focused on a main beam direction 104 of the headlamp 100. The motor vehicle headlamp 100 includes a light source module 10 as described above. In the presented example, the module is arranged inside a receptacle section 106 of the headlamp 100 designed as a socket opening. In the presented example, the receptacle section 106 is located in a section of the motor vehicle headlamp 100 that is opposite from the main beam direction 104.

The motor vehicle head lamp 100 also includes an optical emission unit 108, which entails both a primary optics unit as well as a secondary optics unit 112 in the presented example. The secondary optics unit 112 forms a section of the headlamp through which the emittable light distribution 102 passes during operation of the headlamp 100. The primary optics unit 110 is designed as a primary reflector section 114 of a headlamp housing 116 in the presented example. The secondary optics unit 112 is designed as a projection lens.

The receptacle section 106 is designed as a socket opening, through which the tube-shaped transmission housing 38 of the light source module 10 can be slid into the inner part of the headlamp housing 116. In the assembled state shown in FIG. 2, the carrier base 34 of the light source unit 10 is in contact with the receptacle section 106 that is limiting the socket opening. In one embodiment, there are matching mounting measures provided on the headlamp housing 116 as well as the carrier base 34. These are not shown in detail as part of the Figure.

In the assembled state shown in FIG. 2, the carrier component 26 is arranged in combination with the attached optically effective components (cf. FIG. 1) in reference to the optical emission unit in such a manner that the mixed light distribution 18 emitted by the light source module 10 hits the primary reflector section 114 and is therefore deflected by the primary optics unit 110. The supplemental light distribution 24 emitted by the light-emitting diode 20 of the light source module 10 does, on the other hand, not hit the primary reflector section 114 in the presented example, but spreads in the direction of the secondary optics unit 112 from the optical head 22 irrespective of the primary optics unit 110.

With this type of headlamp 100, the optical emission unit 108 is designed and the light source module 10 is arranged in such a manner in reference to the optical emission unit 108 that during operation of the headlamp, the mixed light distribution 108 feeds a spot light distribution of the headlamp 100, which, for example, allows for an intensive illumination of a central area of the emittable light distribution 102 (long-range spot). The supplemental light distribution 24 is, on the other hand, preferably used in a light distribution intended for an even illumination of a larger area.

An aperture 118 can be arranged along the beam path between the optical head 22 of the light-emitting diode and the secondary optics unit 112 (cf. FIG. 2). Using this aperture 118, it is possible to fade a definable share of the supplemental light distribution 24 prior to it hitting the secondary optics unit 112 in such a way that the share of the emittable light distribution 102 provided by the supplemental light distribution 24 exhibits a light-dark threshold.

The aperture 118 can also, for example, feature an at least partially horizontal (primarily vertical to the main beam direction 104) aperture edge 120. This aperture edge 120 is preferably positioned in such a manner that it passes through the focal point of the secondary optics unit 112 acting as a projection lens. This leads to the circumstance that the light-dark transition of the supplemental light distribution defined by the aperture edge is projected into a light-dark threshold of the emittable light distribution 102 of the headlamp 100 via a secondary optics unit 102. In the presented example, the aperture fades those beams of the supplemental light distribution 24, which would be deflected upward of the light-dark threshold by the secondary optics unit 112.

The mixed light distribution 18 is converted into a primary light distribution 122 by the primary optics unit 110. The aperture 118 is preferably arranged in such a manner (cf. FIG. 2) that the primary light distribution 122 is partially screened by the aperture 118. As can be seen in FIG. 2, a part of the beams of the primary light distribution 122 hits the aperture 118 beneath the aperture edge 120 while another part misses the aperture 118 above the aperture edge 120 and hits the secondary optics unit 112 (projection lens) instead. The center of the mixed light beam preferably hits the aperture 118 slightly beneath the aperture edge 120. The aperture therefore screens all beams of the primary light distribution 122, which would be deflected above the light-dark threshold by the secondary optics unit 112. Using this arrangement, it is possible to achieve an emittable light distribution 102 with a light-dark threshold, an evenly wide illumination (provided by the supplemental light distribution 24) and an additional, bright long-range spot adjoining the light-dark threshold beneath the light-dark threshold.

The aperture 118 can also be provided as a movable (for example folding) mechanism between a low beam position (where it is in the beam path of the primary light distribution 122 and the supplemental light distribution 24, cf. FIG. 2) and a neutral position (where the aperture 118 is swiveled out of the beam path, meaning that it leaves the light distributions 122 and 24 largely unaffected).

In the neutral position, the aperture 118 (open aperture) forms an intensive high beam distribution using the mixed light distribution 18 converted by the primary optics unit 110 and the secondary optics unit 112. The supplemental light distribution 24 forms a wide, horizontal light distribution intended for even illumination after passing through the secondary optics unit 112. This finally results in a high beam configuration with a maximum range and an even illumination.

In the low beam position (closed aperture), the secondary optics unit 112 generates a low beam light distribution as shown in FIG. 2 through projection of the aperture edge 120 and the light beams emitting past it. Depending on the application, the supplemental light distribution 24 can be sufficient here by itself. The mixed light distribution 18 is, however, capable (if required after conversion into the primary light distribution 122) to provide a long-range spot beneath the light-dark threshold if needed (see above with regards to FIG. 2).

The laser light source and the light-emitting diode can be actuated to emit light or turned on/off independently of one another. This makes it possible to provide an adaptive emittable light distribution 102 with a mixed light distribution 18 added as needed (or a primary light distribution 122) to provide a long-range spot (for example with a closed aperture, cf. FIG. 2). Regarding the use as a motor vehicle headlamp, this can, for example, be advantageous for fast driving on country roads, whereas the long-range spot can be deactivated in other situations, such as city traffic.

Variants without an aperture 118 would also be conceivable. The headlamp 100 can then provide a high beam function with an intensive spot and a widely illuminated supplemental light distribution.

As the light-emitting diode 20 already has its own optical head 22 used to form a suitable basic light distribution and the mixed light distribution 18 can be converted into the desired light distribution by a primary optics unit 110, the secondary optics unit 112 can also be omitted for a motor vehicle headlamp 100. In this case, the light-emitting diode 20 can, for example, directly feed the light distribution of the headlamp through the optical head 22. The primary light distribution 122 converted into the mixed light distribution 18 by the primary optics unit 110 can then provide the intensive high beam component at the same time. The supplemental light distribution 24 can also be provided with its own secondary optics unit (for example a projection lens) in addition to the optical head 22 of the light-emitting diode 20, which leaves the light distributions 18, 122 unaffected. In particular, variants are conceivable, where the secondary optics unit 112 only affects the supplemental light distribution 24, but not the mixed light distribution 18 or the primary light distribution 122.

In order to actuate the low beam and high beam distributions independently of one another, the light source module 10 in accordance with this invention is preferably provided with contacts for the electrical power supply in the area of the carrier base 34 and/or the carrier component 26 that are independent of one another and are assigned to the laser light sources 12*a*, 12*b* on one side and the light-emitting diode 20 on the other. From these contacts, electrical power supply lines can run to the light sources 12*a*, 12*b* and 20. These can be routed along a surface of the carrier component 26 or be embedded in the carrier component 26.

The invention has been described in an illustrative manner. It is to be understood that the terminology which has been used is intended to be in the nature of words of description rather than of limitation. Many modifications and variations of the invention are possible in light of the above teachings. Therefore, within the scope of the appended claims, the invention may be practiced other than as specifically described.

What is claimed:

1. A light source module for motor vehicle headlamps, said module comprising:

at least one laser light sources for the emission of laser light, a photo luminescence element, that generates a mixed light distribution emitted from laser light under the influence of photo luminescence and which is arranged in such a manner that the laser light of at least one laser light source can hit the photo luminescence element, at least one light-emitting diode used to generate a supplemental light distribution, whereas at least one laser light source, the photo luminescence element and at least one light-emitting diode is permanently arranged on one joint carrier component as a physical unit;

wherein the carrier component has a front section in reference to the carrier's longitudinal direction and a base section located behind the former, whereas at least one light-emitting diode is arranged on the front section and the laser light source is positioned on the base section.

2. The light source module as set forth in claim 1, wherein the photo luminescence element is arranged on the front section and that at least one laser guidance optics unit is provided to guide the laser light of at least one laser light source to the photo luminescence element.

3. The light source module as set forth in claim 1, wherein an optical head is provided for at least one light-emitting diode, which leaves the mixed light distribution emitted by the photo luminescence element unaffected.

4. The light source module as set forth in claim 1, wherein the carrier component has a transmission channel, which runs between two opposing surfaces of the carrier component.

5. The light source module as set forth in claim 1, wherein the carrier component has a heat sink section, which is positioned in such a way that the laser light source and/or the light-emitting diode and/or the photo luminescence element can be cooled.

6. The light source as set forth in claim 1, wherein a carrier base is provided, which has alignment measures used to align the light source module when installed inside a headlamp and/or mounting measures used to mount the light source module inside a headlamp.

7. The light source module as set forth in claim 1, wherein a transmission housing is provided, which surrounds at least a section of the carrier component, whereas the transmission housing has at least a transparent transmission area through which the light of the mixed light distribution and the supplemental light distribution can be emitted.

8. A motor vehicle headlamp comprising:

a light source module having at least one laser light source for the emission of laser light, a photoluminescent element that generates a mixed light distribution emitted from laser light under the influence of photoluminescence and which is arranged in such a manner that the laser light of at least one laser source can hit the photoluminescent element, at least one light emitting diode used to generate a supplemental light distribution, wherein at least one laser light source, the photoluminescent element and at least one light emitting diode is permanently arranged on one joint carrier component as a physical unit, and an optical emission unit which acts to convert the initial light distribution of said light source module into a low beam distribution of said headlamp;

wherein the light source module cooperates with the optical emission unit in such a manner that the mixed light distribution is converted into a high beam distribution and the supplemental light distribution is converted into a low beam light distribution during operation of the headlamp.

* * * * *